US006622997B2

(12) United States Patent
Emerson

(10) Patent No.: US 6,622,997 B2
(45) Date of Patent: Sep. 23, 2003

(54) STRAIGHT EDGE CLAMPING DEVICE FOR CLAMPING WORKPIECES

(76) Inventor: Eugene E. Emerson, 14116 Hight St., Whittier, CA (US) 90605

( * ) Notice: Subject to any disclaimer, the term of this patent is extended or adjusted under 35 U.S.C. 154(b) by 0 days.

(21) Appl. No.: 10/038,926

(22) Filed: Dec. 31, 2001

(65) Prior Publication Data

US 2003/0122294 A1 Jul. 3, 2003

(51) Int. Cl.[7] ..... B25B 1/02

(52) U.S. Cl. ..... 269/166; 269/164; 269/303; 269/315; 269/254 R

(58) Field of Search ..... 269/166, 164, 269/303, 315, 254 R, 88–89, 90, 170, 279, 152, 157, 216, 224; 144/303, 359, 371; 83/468; 33/433, 42

(56) References Cited

U.S. PATENT DOCUMENTS

| | | | | | |
|---|---|---|---|---|---|
| 917,488 | A | | 4/1909 | Roberts | 408/109 |
| 1,128,970 | A | | 2/1915 | Godefroy et al. | |
| 2,497,733 | A | | 2/1950 | Kebour | 408/109 |
| 2,849,900 | A | | 9/1958 | Heidtman, Jr. | 408/112 |
| 3,534,639 | A | | 10/1970 | Treichler | 408/112 |
| 3,626,513 | A | | 12/1971 | Pytlak | 408/115 R |
| 4,095,345 | A | * | 6/1978 | Smith | 33/80 |
| 4,330,228 | A | | 5/1982 | Beyl | |
| 4,394,800 | A | * | 7/1983 | Griset | 33/443 |
| 4,466,601 | A | | 8/1984 | Raines | |
| 4,490,920 | A | * | 1/1985 | Griset | 33/443 |
| 4,499,667 | A | * | 2/1985 | Griset | 33/446 |
| 4,842,453 | A | | 6/1989 | Raines et al. | |
| 4,952,101 | A | | 8/1990 | Coombs | |
| 4,955,766 | A | | 9/1990 | Sommerfeld | |
| 5,308,199 | A | | 5/1994 | Juang | |
| 5,322,396 | A | * | 6/1994 | Blacker | 408/72 |
| 5,348,276 | A | * | 9/1994 | Blacker | 269/88 |
| 5,507,607 | A | | 4/1996 | Ericksen et al. | |
| 5,676,500 | A | | 10/1997 | Sommerfeld | |
| 5,791,835 | A | | 8/1998 | Chiang et al. | |
| 5,964,041 | A | * | 10/1999 | Daniel | 33/403 |
| 6,050,559 | A | * | 4/2000 | de Souza | 269/208 |
| 6,135,435 | A | * | 10/2000 | Schimtz | 269/164 |
| 6,254,320 | B1 | | 7/2001 | Weinstein et al. | |
| 6,394,712 | B1 | * | 5/2002 | Weinstein | 408/103 |

FOREIGN PATENT DOCUMENTS

| | | |
|---|---|---|
| DE | DT1728506 A1 | 10/1973 |
| DE | DE4310336 A1 | 10/1994 |

* cited by examiner

*Primary Examiner*—Joseph J. Hail, III
*Assistant Examiner*—Daniel Shanley
(74) *Attorney, Agent, or Firm*—Park & Sutton LLP; John K. Park

(57) ABSTRACT

A straight edge clamping device for clamping workpieces is provided. The device comprises a straight edge having a flat lower surface for contacting workpieces, an upper wall, and two sidewalls, a first stop fixed at one end of the edge, a second stop movably provided along the edge, and a clamp for holding the workpieces together. The walls of the edge define an open channel. The second stop has a body movably received in the channel of the edge and having a shape reverse to the shape of the channel of the base so that the body and the channel interlock. The upper wall of the base has one or more recesses, and the body of the second stop has mating projections so that the recesses and the projections interlock.

19 Claims, 19 Drawing Sheets

STRAIGHT EDGE CLAMPING DEVICE FOR CLAMPING WORKPIECES

BACKGROUND OF THE INVENTION

The present invention relates to a straight edge clamping device. More particularly, the invention relates to a straight edge clamping device used to secure workpieces and to guide a power tool along the straight edge.

Straight edge clamps are used in wood working for having a straight edge secured to a workpiece or workpieces so that a power tool or a guide for a power tool can be moved along the straight edge, for example, to form a cut edge with a circular hand saw or to form a trimmed edge with a hand router. Also, straight edge clamps are used for the purpose of holding accessory tool against a workpiece, for example, to form pocket holes.

A straight edge clamp by prior art includes a straight edge that is made of extruded aluminum and has an open channel, a fixed stop, a sliding stop that is received in the channel and can slide along the straight edge, and a bar or rod clamp. The sliding stop has a body that is inserted in the channel of the straight edge, and a jaw that protrudes from the body and out of the channel to secure a workpiece.

The shape of the straight edge, thickness of its cross-section, and manufacturing tolerance of extruded aluminum affects the stability of the straight edge when working on workpieces, such as making a cut with a hand circular saw, or hand router, or drilling pocket holes with an attached accessory tool.

When the workpiece are clamped between the fixed stop and the sliding stop with the clamping action of the bar clamp, the jaw of the sliding stop is forced against the workpiece, and the body of the sliding stop binds itself within the channel of the straight edge between the top and bottom surfaces of the channel.

The problem in a straight edge clamp by prior art is that aluminum extrusion products used for making straight edges has a minimum dimension variation of 20 mil, and this variation is the potential amount of movement of the straight edge even when the bar clamp of the straight edge clamp is securely engaged. The problem is inherent in the nature of aluminum extrusion.

The variation is affected by many factors such as shape, size and thickness of the straight edge. Such factors also affect the cost of the extrusion and ultimately the cost of the straight edge. Increasing the thickness of the straight edge for example will decrease the manufacturing dimension variation and increase accuracy and usability of the straight edge clamp. However, it increases the ultimate manufacturing cost of the straight edge clamp beyond practicality.

Accordingly, there has been a demand for a more stable straight edge clamp without any appreciable difference in manufacturing cost.

SUMMARY OF THE INVENTION

The present invention is contrived to overcome the conventional disadvantages. Therefore, an object of the invention is to provide a straight edge clamp having improved stability of its position while the clamp is engaged without increasing the manufacturing cost of the clamp.

Another object of the invention is to provide a straight edge clamp that enables a power tool to cut a workpiece more accurately when the workpiece is secured by the clamp.

To achieve the above-described objects, in accordance with an embodiment thereof, the invention provides a straight edge clamping device for clamping workpieces that comprises an elongated hollow base having a constant cross-section and having a first end, a second end, a flat lower wall for contacting workpieces, an upper wall, and two sidewalls connecting the lower wall and the upper wall, a first stop fixed at the first end of the base, a second stop movably provided along the base, and a clamp for holding the workpieces together. The lower wall of the base has an opening, and the opening, the lower wall, the upper wall, and the sidewalls of the base define a channel. The second stop has a body movably received in the channel of the base and a stop for securing the workpieces. The body of the second stop has a shape reverse to the shape of the channel of the base so that the body and the channel interlock. The upper wall of the base has one or more recesses, and the body of the second stop has one or more projections having a shape reverse to the shape of the recesses so that the recesses and the projections interlock.

The base may further comprise two slant walls between the sidewalls and the upper wall. The angle between the slant walls and the sidewalls is approximately 45 degrees.

The first stop has a body inserted in the channel of the base and a stop for securing the workpieces. The body of the first stop has a shape reverse to the shape of the channel of the base so that the body and the channel interlock. The body of the first stop has one or more projections having a shape reverse to the shape of the recesses so that the recesses and the projections interlock.

The recess of the base is rectangular and has a depth of approximately one sixteenth of an inch, and wherein the projection of the second stop is rectangular and has a height of approximately one sixteenth of an inch.

The recess of the base is rectangular and has a depth of approximately one eighth of an inch, and wherein the projection of the second stop is rectangular and has a height of approximately one eighth of an inch.

The upper wall of the base may further comprise a guide channel, and the clamping device may further comprise a drill guide movably provided along the base. The drill guide has a fastener that is guided in the guide channel of the base.

In accordance with another embodiment thereof, the invention provides a straight edge clamping device for clamping workpieces that comprises an elongated hollow base having a constant cross-section and having a first end, a second end, a flat lower wall for contacting workpieces, an upper wall, and two sidewalls connecting the lower wall and the upper wall, a drill guide attached at the first end of the base, a first stop movably provided along the drill guide, a second stop movably provided along the base, and a clamp for holding the workpieces together. The lower wall of the base has an opening, and the opening, the lower wall, the upper wall, and the sidewalls of the base define a channel. The second stop has a body movably received in the channel of the base and a stop for securing the workpieces. The body of the second stop has a shape reverse to the shape of the channel of the base so that the body and the channel interlock. The upper wall of the base has one or more recesses, and the body of the second stop has one or more projections having a shape reverse to the shape of the recesses so that the recesses and the projections interlock.

The advantages of the present invention are: (1) the straight edge clamp is kept stable after the workpieces are clamped and during wood working on the workpieces; (2) Woodworking accuracy of the finished product improves;

and (3) the improved straight edge clamp can be manufactured without increasing the manufacturing cost appreciably.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION OF THE PREFERRED EMBODIMENTS

FIGS. 1–31 show a pocket hole drilling and screw installation jig 10 according to the first embodiment of the present invention. The jig 10 may also be used as a straight edge clamping device for woodworking.

Figure 1:
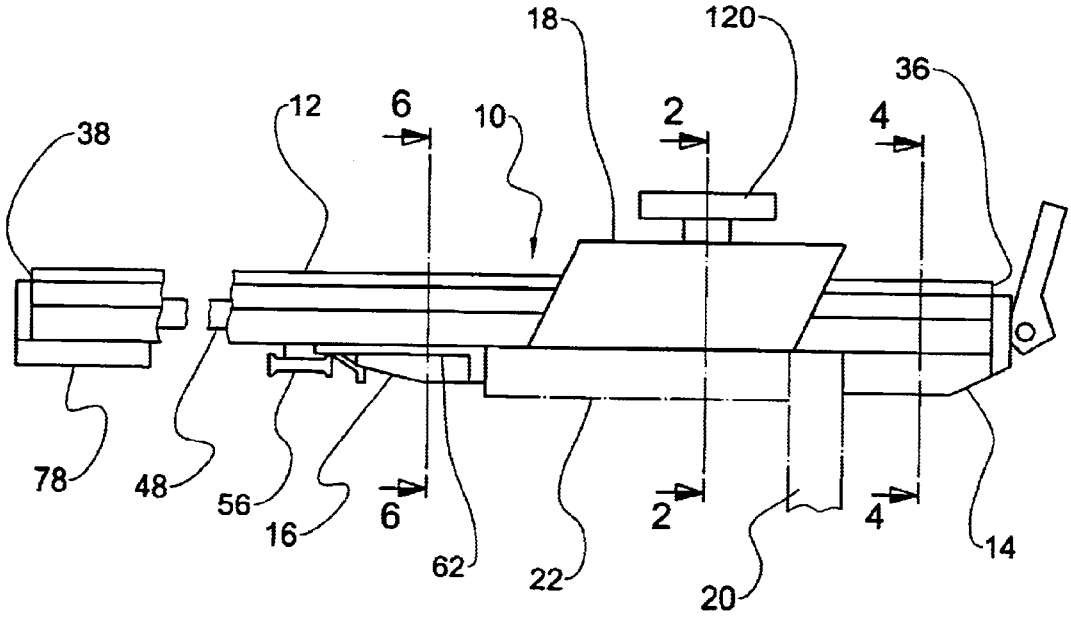
FIG. 1 is a front elevational view of a straight edge clamping device according to an embodiment of the present invention.
Figure 3:
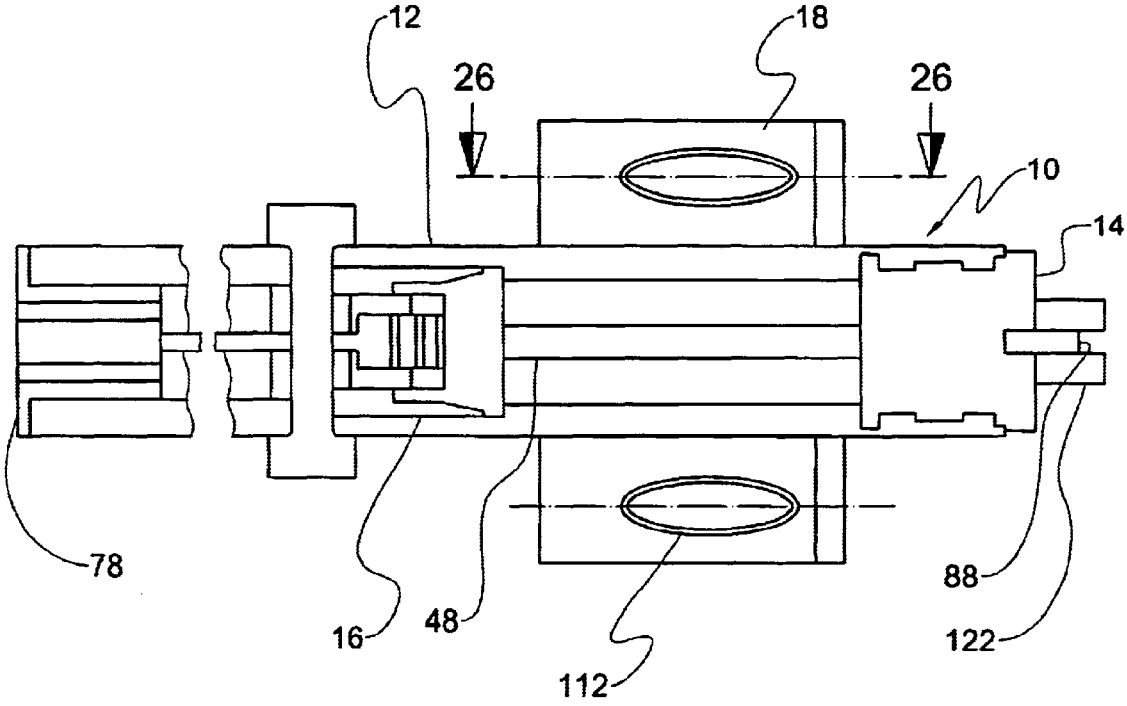
FIG. 3 is a bottom plan view of the jig.

As shown in FIGS. 1 and 3, the jig 10 includes a bar-shaped base or a straight edge 12, a first stop 14, a second stop 16, and a drill guide 18. FIG. 1 also shows two workpieces 20, 22 with imaginary lines.

Figure 2:
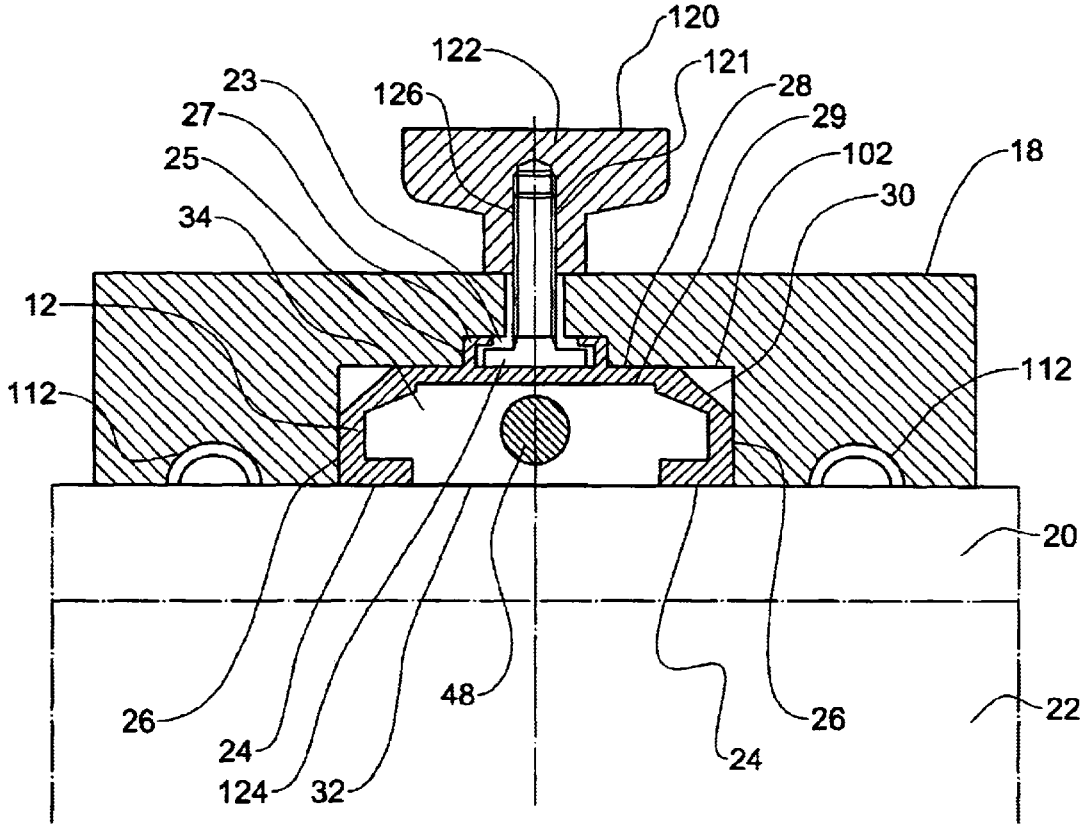
FIG. 2 is a cross-sectional view taken along 2—2 in FIG. 1.

As shown in FIG. 2, the base 12 has a constant cross-section and is typically made of extruded aluminum. The cross-section of the base is defined by two lower walls 24 that form a flat surface which is flush with a surface of the workpiece 20, two sidewalls 26 that extend upward from the lower walls 24, an upper wall 28, and two slant walls 30 that connect the upper wall 28 and the sidewalls 26. The angle between the slant walls 30 and sidewalls 26 is approximately 45 degrees.

Figure 6:
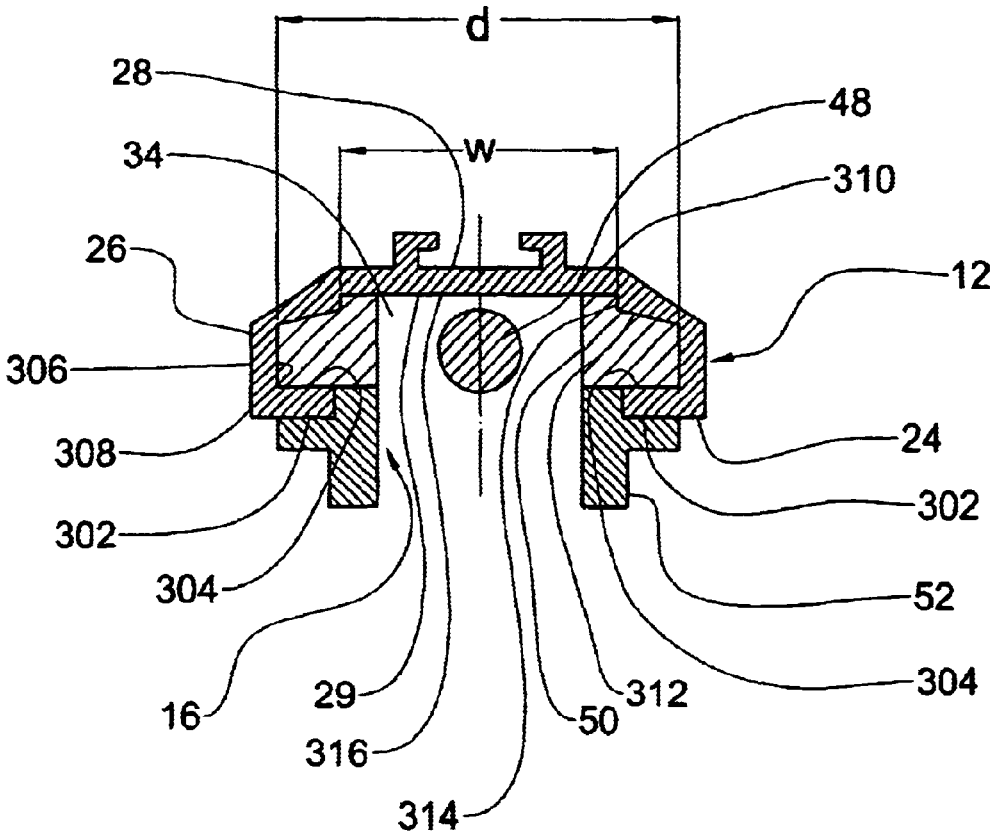
FIG. 6 is a cross-sectional view of a second stop taken along 6—6 in FIG. 1.
Figure 7:
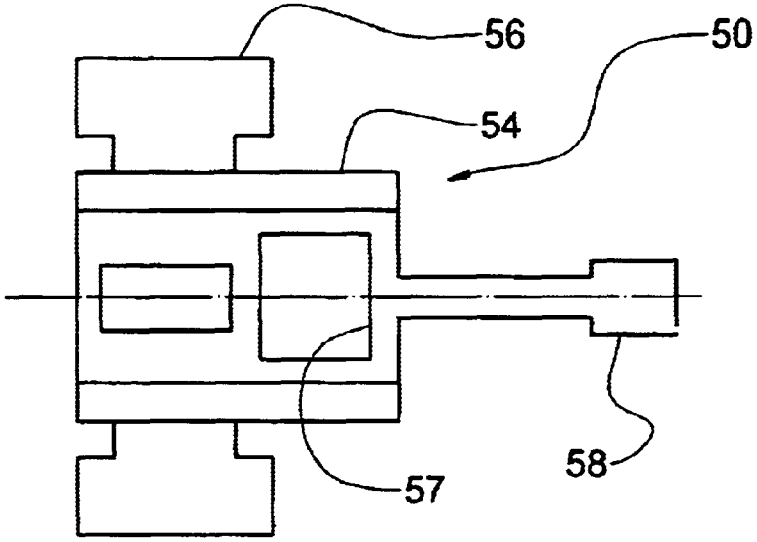
FIG. 7 is a plan view of a body of the second stop.
Figure 8:
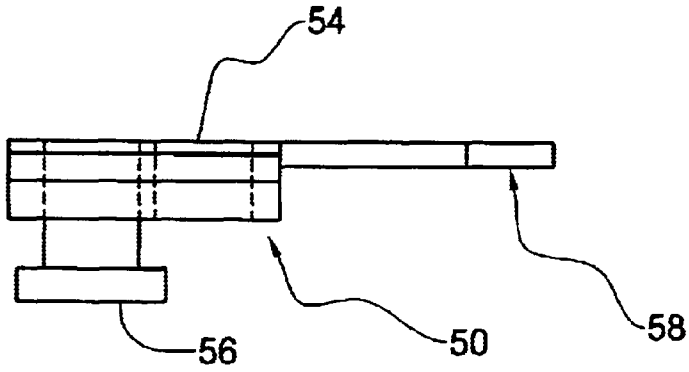
FIG. 8 is an elevational view of the body of the second stop.
Figure 9:
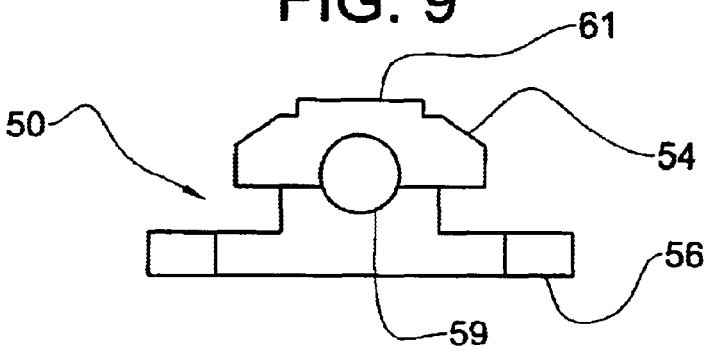
FIG. 9 is a left side elevational view of the body of the second stop.
Figure 10:
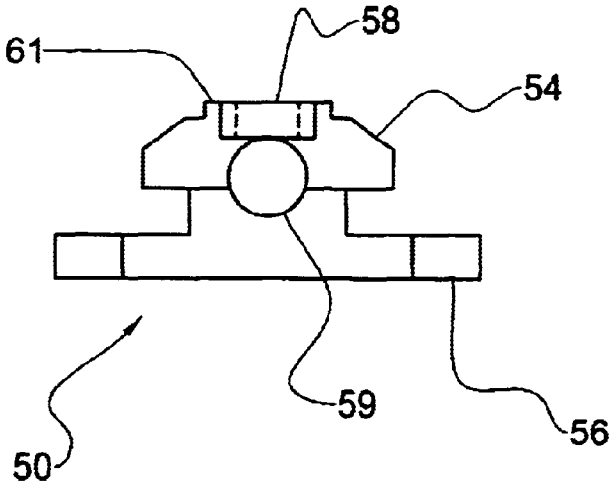
FIG. 10 is a right side elevational view of the body of the second stop.
Figure 11:
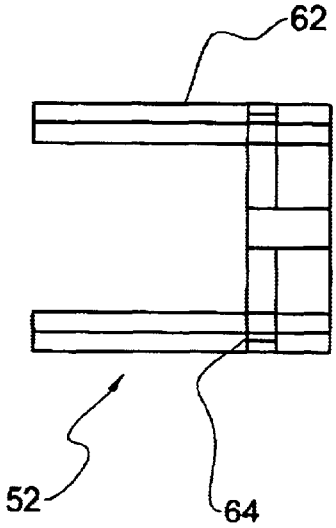
FIG. 11 is a plan view of a slider of the second stop.
Figure 14:
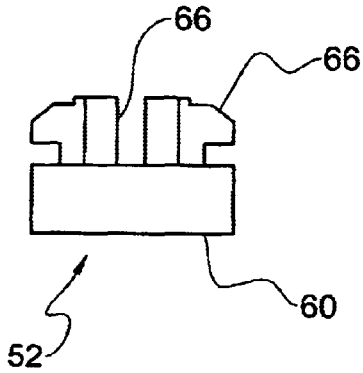
FIG. 14 is a right side elevational view of the slider of the second stop.
Figure 12:
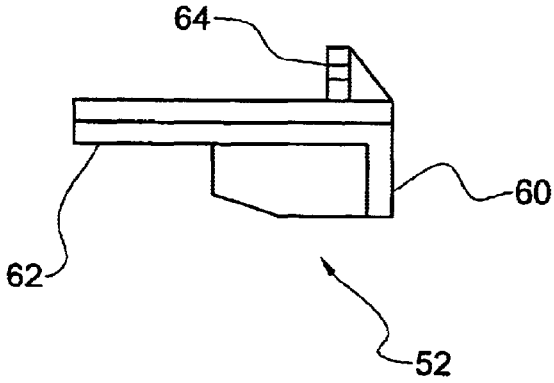
FIG. 12 is a front elevational view of the slider of the second stop.
Figure 13:
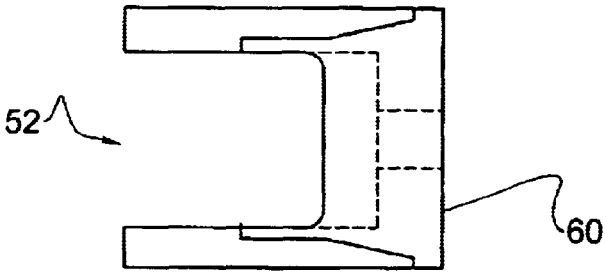
FIG. 13 is a bottom plan view of the slider of the second stop.
Figure 15:
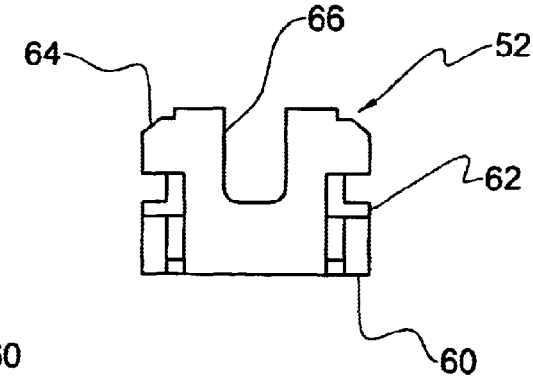
FIG. 15 is a left side elevational view of the slider of the second stop.

As shown in FIG. 6, the lower wall 24 has an outer-lower wall 302 and an inner-lower wall 304. The sidewall 26 has an outer-side wall 306 and an inner-side wall 308. The upper wall 28 has an outer-upper wall 310 and an inner-upper wall 312. The inner-upper wall 312 has a recess 29. The recess 29 has two vertical-inner-upper wall 314 and a horizontal-inner-upper wall 316.

The inner-lower walls 304, the inner-side walls 308, the inner-upper wall 312, and the recess 29 form an open channel 34.

The width w of the recess 29 is smaller than the distance d between the two inner-side walls 308 by a predetermined distance.

The upper wall 28 has a recess 29. The recess 29 provides additional interlocking effect to elements received in the channel 34, that is, the first stop 14 and the second stop 16, etc. The recess 29 is rectangular and has a depth of approximately one sixteenth of an inch, or one eighth of an inch. The width and depth of the recess are chosen to ease the manufacturing process and to increase the interlocking ability between the base 12 and the elements received in the base. More than one recesses may provided in the upper wall 28. The recess may be provided in other walls defining the channel 34.

Figure 4:
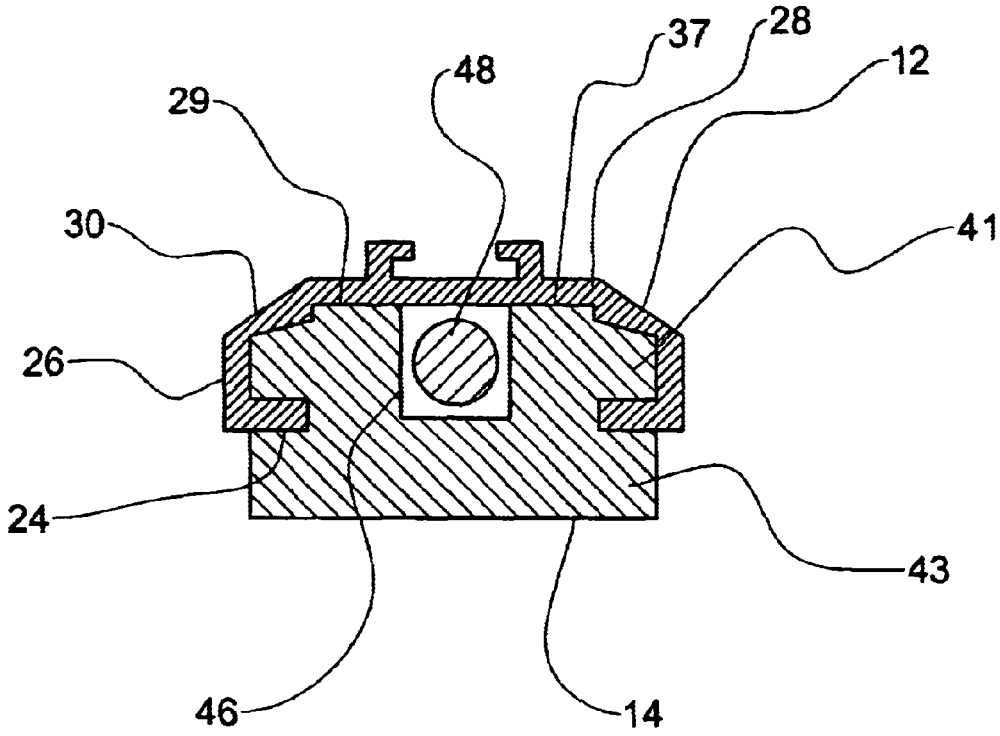
FIG. 4 is a cross-sectional view taken along 4—4 in FIG. 1.
Figure 5:
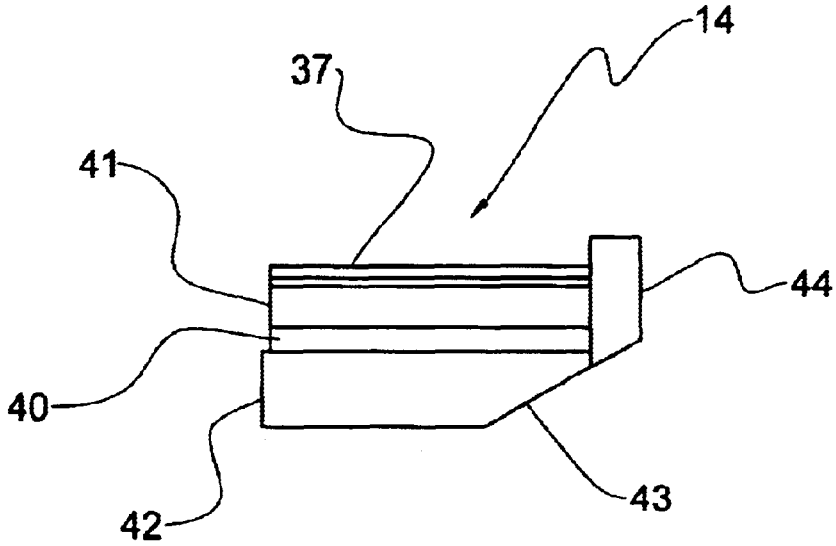
FIG. 5 is an elevational view of a first stop.

The first stop 14 is fixed to the end 36 of the base 12 and is used to secure the workpiece 20. As shown in FIGS. 4 and 5, the first stop 14 has grooves 40 in which the lower walls 24 of the base 12 fit tightly. The portion of the first stop 14 received in the channel 34 of the base 12 forms a body 41 of the first stop 14. The body 41 has a shape that is reverse to the channel 34 so that the first stop 14 and the base 12 interlock. The body 41 has a projection 37 that interlocks with the recess 29 of the base 12. The portion of the first stop 14 outside the channel 34 forms a stop 43. The stop 43 has a jaw or wall 42 that contacts the workpiece 20. The first stop 14 also has an end wall 44 that is opposite to the jaw 42 and covers the end 36 of the base 12, and a channel 46 that receives a rod 48. The rod 48 is received within the channel 34 of the base 12.

The second stop 16 is received in the channel 34 of the base 12 and movable along the base 12. The second stop 16 is used to secure the workpiece 22. As shown in FIG. 6, the second stop 16 has a body 50 that slides in the channel 34 of the base 12, and a slider 52 that slides in the channel 34 and along the lower wall 24 of the base 12 and contacts the workpiece 22.

FIGS. 7–10 show the body 50 of the second stop 16. The body 50 has a sliding portion 54, a handle 56, an opening 57, a stop 58, and a hole 59. The sliding portion 54 has a shape that is reverse to the shape of the channel 34 so that the sliding portion 54 and the channel 34 interlock. The sliding portion 54 has a projection 61 that interlocks with the recess 29 of the base 12. The projection 61 is rectangular and has a height of approximately one sixteenth of an inch, or one eighth of an inch. The opening 57 is provided in the sliding portion 54. The handle 56 is provided below the sliding portion 54 so that a worker can hold it by hand to move the second stop 16 along the base 12. The stop 58 horizontally extends from the sliding portion 54. The hole 59 is provided in the middle of the second stop 16 to receive the rod 48.

FIGS. 11–15 show the slider 52 of the second stop 16. The slider has the role of a stop securing a workpiece. The slider has a jaw 60, a rail 62, a projection 64, and a channel 66. The rail 62 slides over the lower wall 24 of the base 12. The jaw 60 is provided below the rail 62 and contacts the workpiece 22. The projection 64 is provided above the rail 62 and has a shape that is reverse to the shape of the channel 34 of the base 12 so that the projection 64 and the channel 34 interlock. The channel 66 receives the rod 48.

Figure 16:
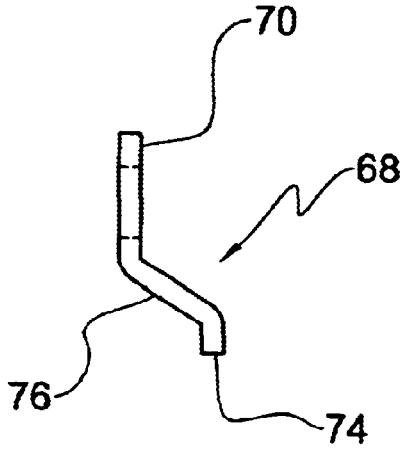
FIG. 16 is a side elevational view of a locking element of the second stop.
Figure 17:
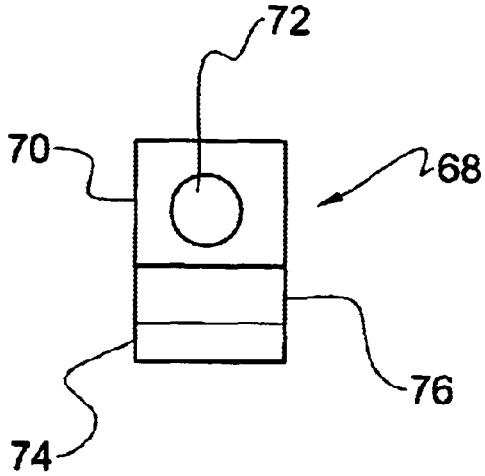
FIG. 17 is a front elevational view of the locking element of the second stop.

FIGS. 16 and 17 show a locking element 68. The locking element 68 has a flat portion 70, a hole 72 provided in the flat portion 70, an end 74, and a bent portion 76 that connects the flat portion 70 and the end 74.

Figure 18:
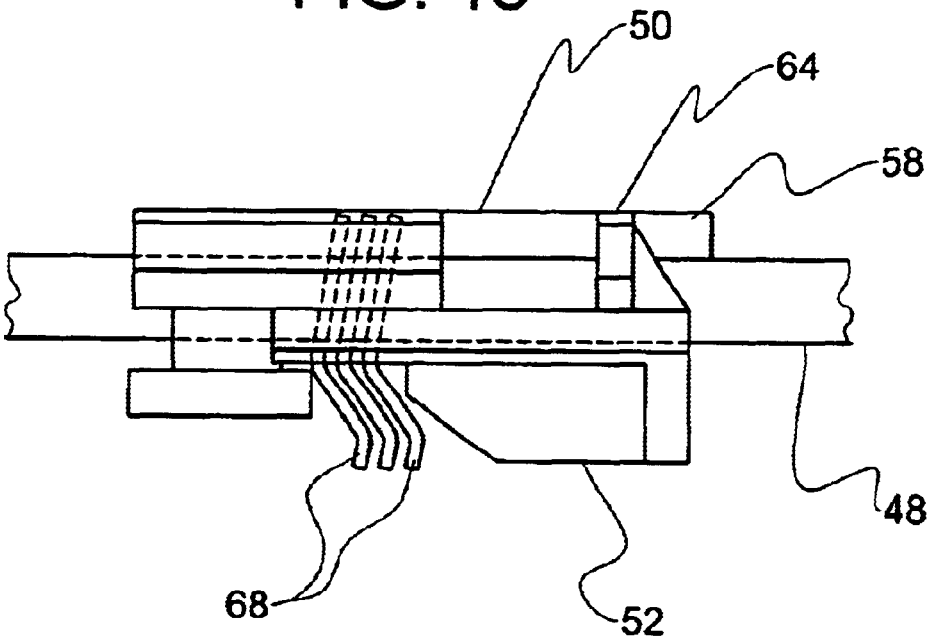
FIG. 18 is an elevational view showing a released state of the second stop.
Figure 19:
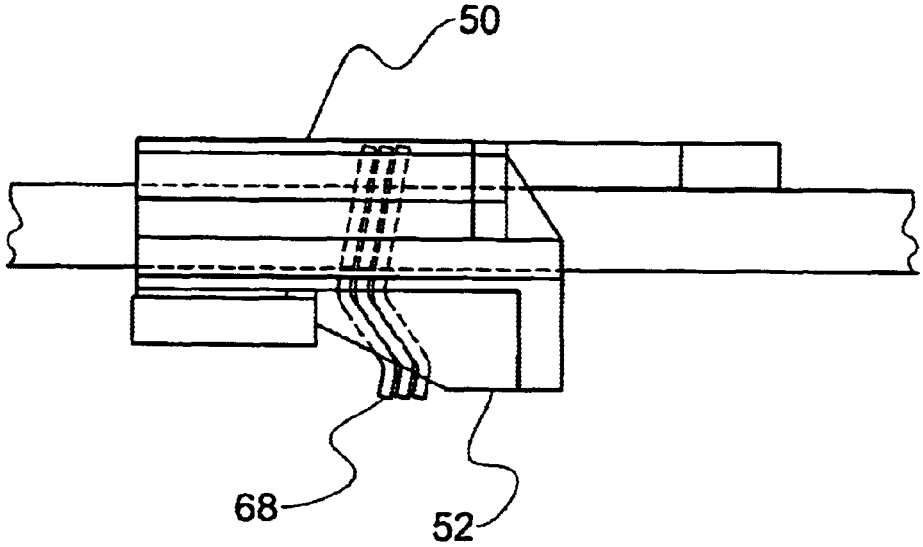
FIG. 19 is an elevational view showing a locked state of the second stop.

FIG. 18 shows a released state of the second stop 16. FIG. 19 shows a locked state of the second stop 16. A plurality of the locking elements 68 is positioned in the opening 57 of the second stop 16. The rod 48 passes through the hole 59 of the second stop 16 and the holes 72 of the locking elements 68. In the released state, the body 50 is away from the slider 52 so that there are spaces between the locking elements 68 and thus, the locking elements 68 are loose from each other and from the rod 48. The second stop 16 can move along the rod 48 freely. The body's away movement is stopped when the projection 64 of the slider contacts the stop 58 of the body 50. In the locked state, the body 50 moves toward the slider 52 and the locking elements 68 are tightened between the body 50 and the slider 52 so that there are no gaps between the locking elements 68. Thus, in the locked state, the slider 52 moves integrally with the body 50.

In the locked state, the second stop 16 can move toward the first stop since the body 50 pushes the locking elements 68 near the center of the rod 48 and the pushing force is applied uniformly around the hole 72, and the locking elements 68 can slide along the rod 48. However, moving in reverse direction is blocked since the slider 52 pushes the ends 74 of the locking element 48 and the pushing force is applied at a point offset from the center of the holes 72 and the rod 48, thereby locking the holes 72 on the rod 48.

Figure 20:
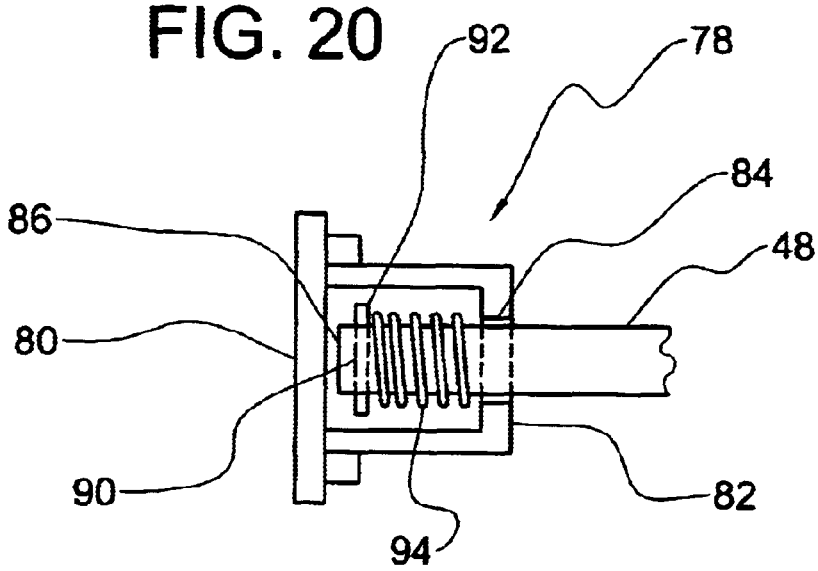
FIG. 20 is a plan view of an end cap.
Figure 21:
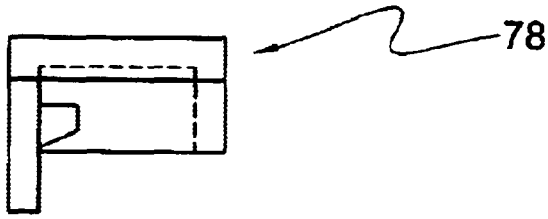
FIG. 21 is an elevational view of the end cap.

FIGS. 20 and 21 show an end cap 78 that is fixed at the end 38 of the base 12. The end cap 78 has a wall 80 that covers the end 38, and a wall 82 that is opposite to the wall 80. The wall 82 has a channel 84 that receives the rod 48. The rod 48 has two ends 86, 88. A hole 90 is provided at the end 86 of the rod 48. A pin 92 is inserted into the hole 90 forming a stop. A spring 94 surrounds the rod 48 between the pin 92 and the wall 82 of the end cap 78 so that displacement of the spring 94 is confined between the pin 92 and the wall 82.

Figure 22:
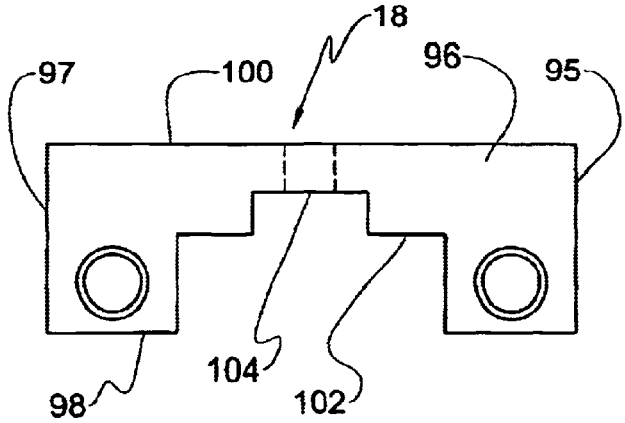
FIG. 22 is a left side elevational view of the drill guide.
Figure 23:
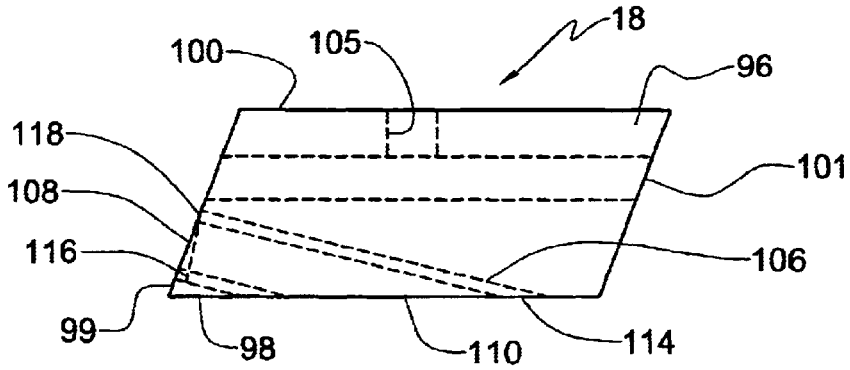
FIG. 23 is a front elevational view of the drill guide.
Figure 24:
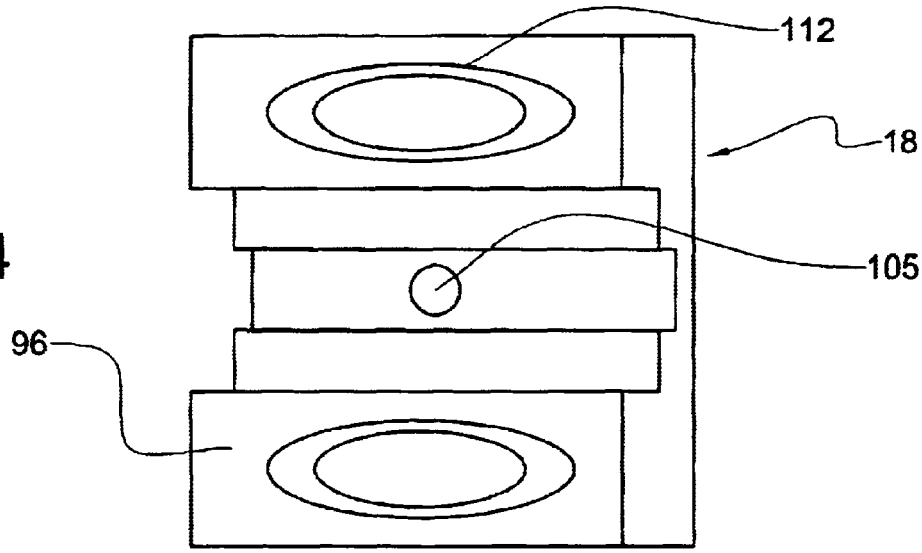
FIG. 24 is a bottom plan view of the drill guide.

FIGS. 22–24 show the drill guide 18. The drill guide 18 has a body 96. The body has a flat lower surface 98, an upper surface 100, and two sidewalls 95, 97 and two slant walls 99, 101 connecting the lower surface 98 and the upper surface 100. The lower surface 98 is parallel with the lower wall 24 of the base 12 when the drill guide 18 is assembled in the jig 10. The lower surface 98 has a recess 102 formed in the middle of the lower surface 98. A smaller recess 104 is formed in the middle of the recess 102. The recesses 102, 104 receive the base 12 such that the drill guide 18 can slide over the base 12. The recess 104 has a hole 105 in the middle of it. The body 96 further has two through holes 106 longitudinally and obliquely formed within the body 96. The hole has an upper end 108 and a lower end 110. The lower end 110 terminates flush with the lower surface 98. The upper end 108 of the hole 106 is positioned at the slant wall 99. The angle between the hole 106 and the lower surface 98 is approximately 14 degrees.

The material of the body 96 should be rigid to support a drill during drilling pocket holes in the workpiece and should withstand the heat associated with the drilling. Cast, extruded aluminum or molded heat resistant plastic is suitable for the material.

Two drill guide portions 112 that have a shape of a bushing is inserted into the hole 106 of the body 96. Each of the drill guide portions 112 has a lower end 114 and an upper end 116. The lower end 114 terminates flush with the lower surface 98. The upper end 116 of the hole 106 is positioned at the slant wall 99. A stop flange 118 is formed at the upper end 116 of the drill guide portion 112 to limit drilling distance when pocket holes are drilled. The material of the drill guide portion 112 should be resistant to the friction and wear produced during drilling pocket holes in the workpiece. Hardened steel is suitable for the material.

Alternatively, the drill guide portions 112 may not be provided and the holes 106 may act as drill guide portions. In this case, a stop flange is formed on the upper ends 108 of the holes 106.

Referring to FIGS. 2 and 22–24, how the drill guide 18 is clamped to the base 12 is explained. A knob 120 having a threaded hole 121 is engaged with a nut 123 having a head 124 and a threaded portion 126. The threaded portion 126 of the nut 123 passes through the hole 105 of the drill guide 18. The head 124 is slidably received in the channel 23 of the base 12. As the knob 120 is tightened, the drill guide 18 is pressed against the workpiece 20, and the lower surface 98 of the drill guide 18 is held securely against the workpiece.

Figure 25:
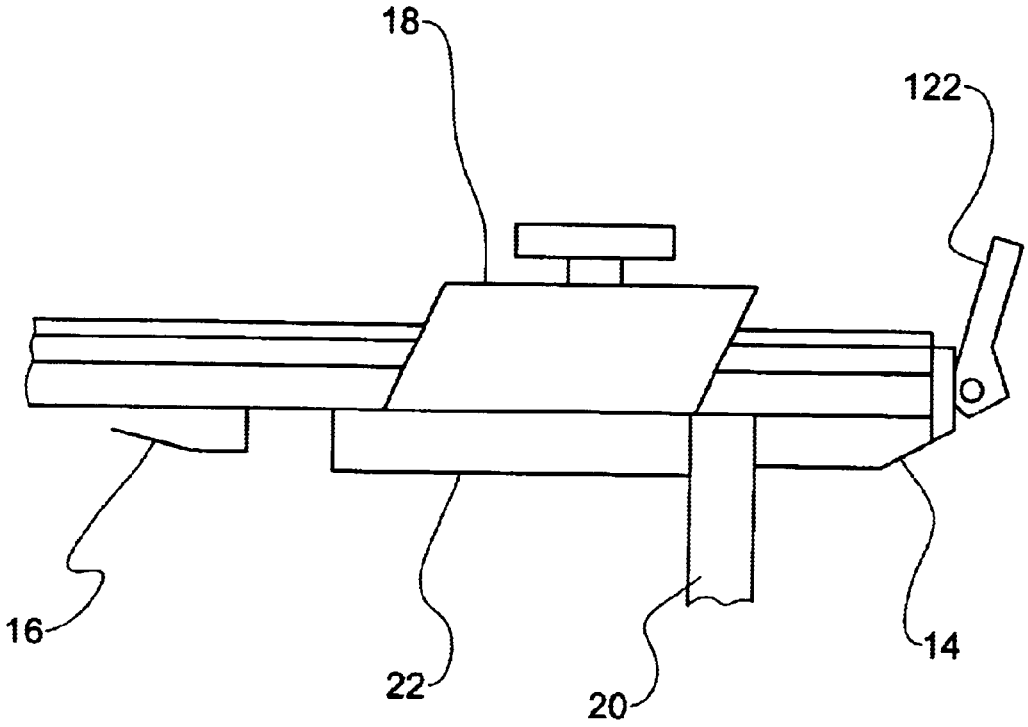
FIG. 25 is a partial, front elevational view of the jig showing the step of positioning and clamping workpieces.

FIGS. 25–28 show the steps that occur during the operation of drilling pocket holes and assembling the workpieces. FIG. 25 shows the jig 10 and workpieces 20, 22 before they are secured between the stops 14, 16. The workpieces 20, 22 are positioned as their final state to be assembled. The workpiece 22 contacts the lower wall 24 of the base 12. The workpiece 20 is positioned perpendicular to the workpiece 22. The second stop 16 has not moved toward the workpiece 22 yet. A cam lever 122 is pivotally provided at the end 88 of the rod 48 and buts the end wall 44 of the first stop 14, and is shown in a released state.

Figure 26:
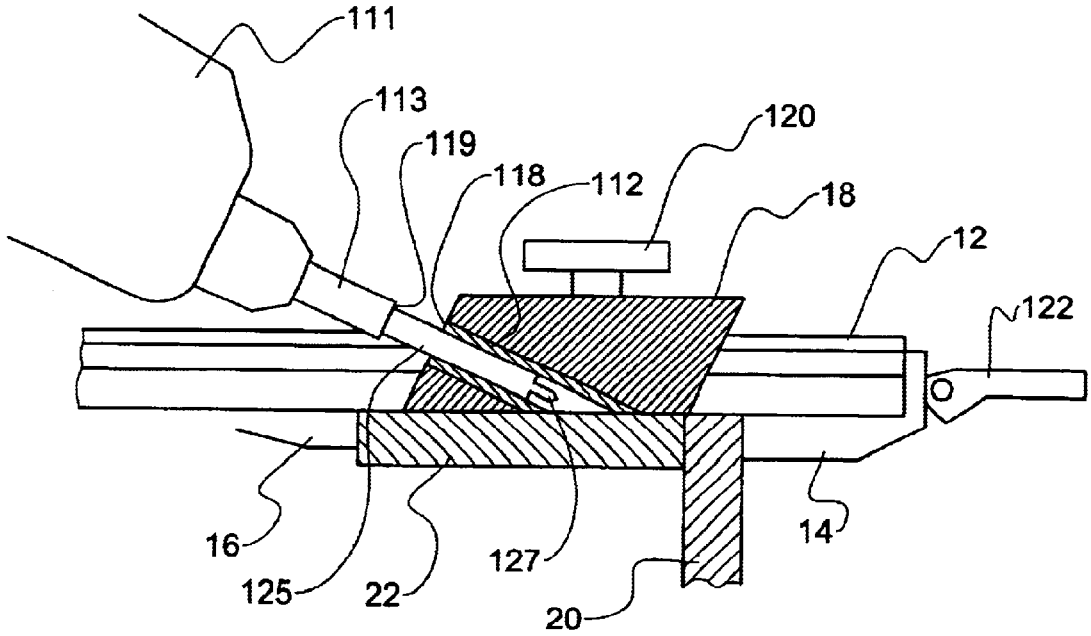
FIG. 26 is a cross-sectional view taken along 26—26 in FIG. 3, showing the step of guiding a drill for forming pocket holes.

FIG. 26 shows that the workpieces 20, 22 clamped between the first stop 14 and the second stop 16. The second stop 16 is moved toward the first stop 14 such that the stops 14, 16 tightly contact the workpieces 20, 22. The cam lever 122 is now pivoted to an engaging state. By the cam action of the cam lever 122, the rod 48 is pulled out from the first stop 14 by a predetermined distance. As the rod 48 is pulled out, the spring 94 is compressed within the end cap 78. When the second stop 16 is moved toward the first stop, the second stop 16 is locked to the rod 48 as explained above referring FIG. 19. Therefore, pulling out of the rod 48 forces the jaw 60 of the second stop 16 to push the workpiece 22 strongly, and the workpieces 20, 22 are tightly clamped. Then the drill guide 18 is slides over the base 12 to a precise location for drilling pocket holes into the workpiece 22. Then the knob 120 is tightened and the drill guide 18 is fixed to the base 12 and pressed against the workpiece 22 providing additional clamping effect for the workpieces 20, 22. Then a drill bit 113 secured in a chuck of a portable drill 111 is inserted into the drill guide portion 112.

The elements related to clamping workpieces, the first stop 14, the second stop 16, the rod 48, the end cap 78, the spring 94, and the cam lever 122 are all positioned in a plane parallel and near to the lower wall 24 of the base 12.

The drill bit 113 has a pocket forming portion 125, a smaller diameter pilot hole forming portion 127 protruding from the pocket forming portion 125 and forming the free end of the drill bit, and a step shank 119 that abuts with the stop flange 118 of the drill guide portion 112 to limit the drilling distance of the drill bit 113.

Figure 27:
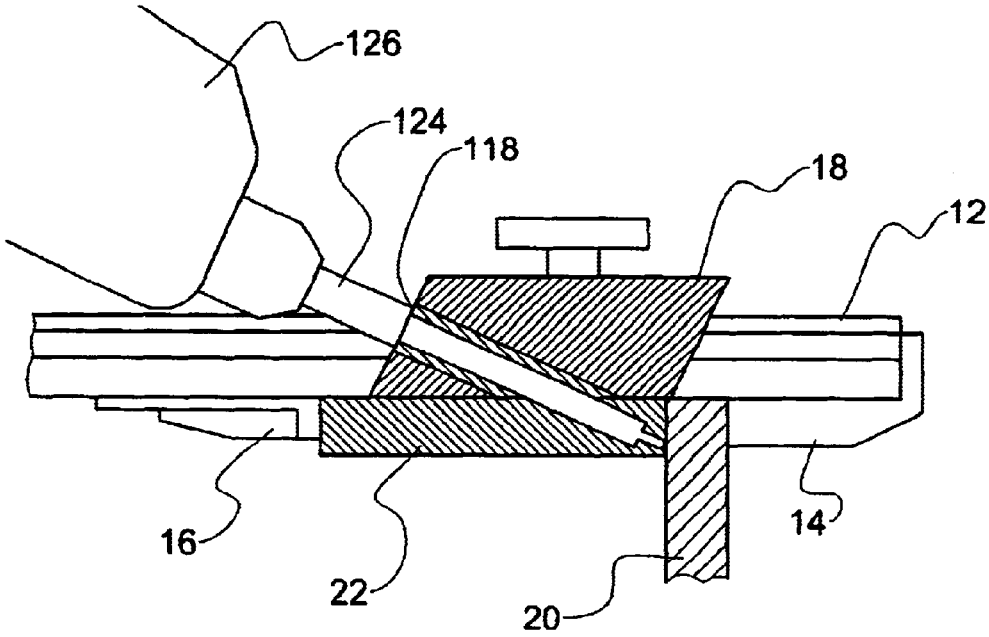
FIG. 27 is a cross-sectional view similar to FIG. 26, showing the step of drilling pocket holes.

FIG. 27 shows that a pocket hole is formed in the workpiece 20. The stop flange 118 prevents the drill bit 113 from drilling more than the required depth of the pocket hole.

Figure 28:
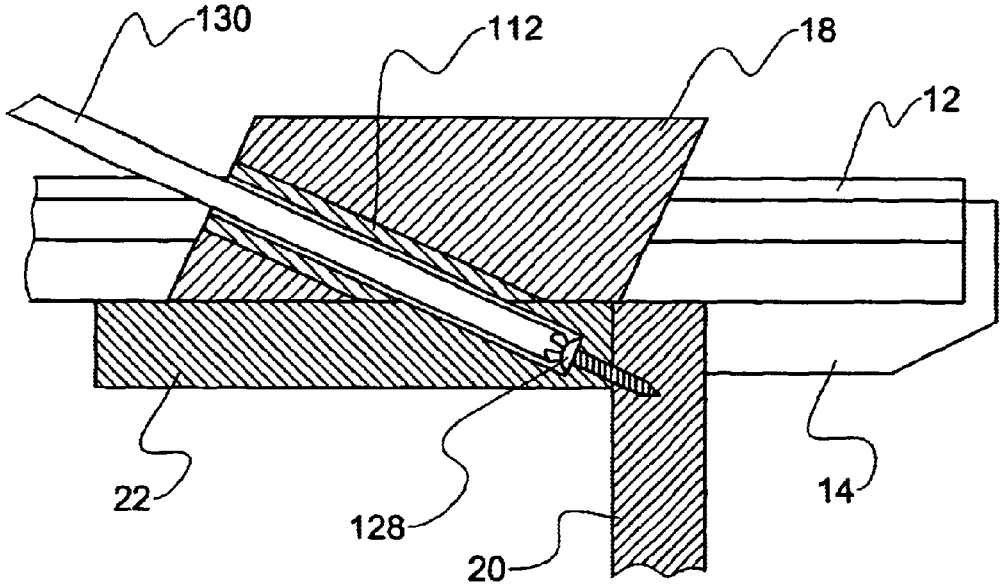
FIG. 28 is a cross-sectional view similar to FIG. 27, showing the step of screw installation.

FIG. 28 shows that a screw 128 is deposited into the pocket hole thus assembling the workpieces 20, 22. A screw driver 130 is guided through the drill guide portion 112 to deposit the screw 128.

After depositing the screw 128, the cam lever 122 is pivoted to the release position. Then the spring 94 pulls in the rod 48. By moving the handle 56 of the second stop 16 away from the workpiece 22, the second stop 16 becomes its released state, as explained above, and further moving of the handle 56 moves the second stop 16 away form the work piece 22. Then the assembled workpieces 20, 22 are removed from the jig 10.

Figure 29:
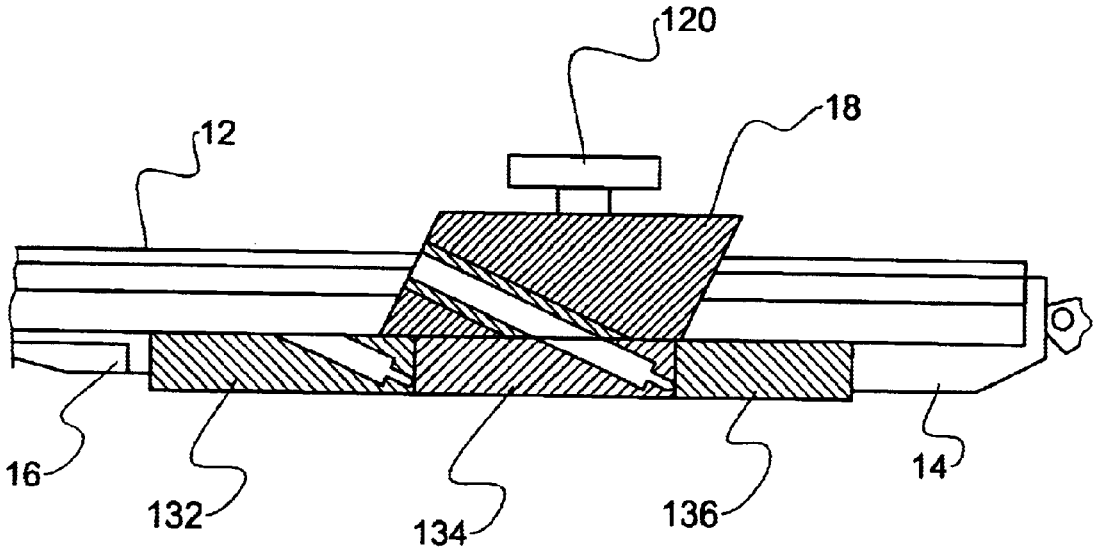
FIG. 29 is a partial, cross-sectional view of the jig showing three workpieces positioned horizontally.

FIG. 29 shows three workpieces 132, 134, 136 clamped by the jig 10. The workpieces are positioned horizontally. The drill guide 18 moves along the base 12 from workpiece to workpiece to form pocket joints.

Figure 30:
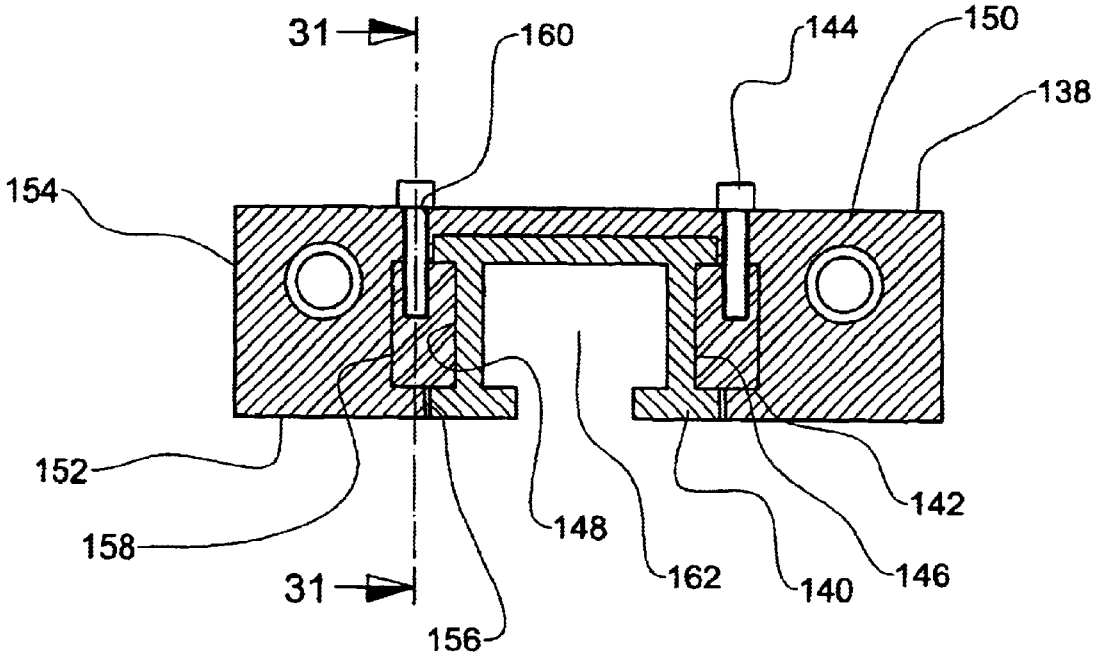
FIG. 30 is a cross-sectional view showing an alternate clamping mechanism of a drill guide.
Figure 31:
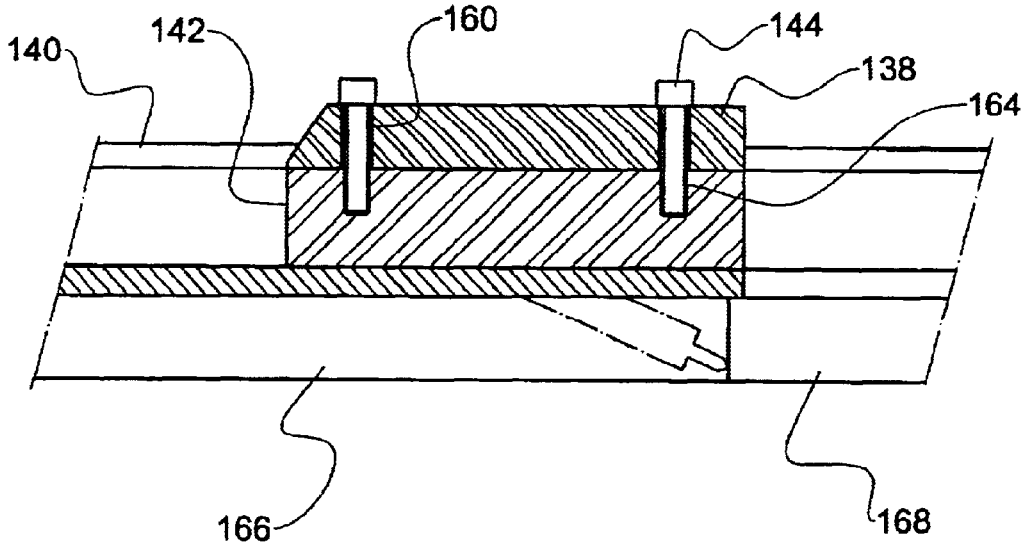
FIG. 31 is a cross-sectional view taken along 31—31 in FIG. 30.

FIGS. 30, 31 show an alternative clamping mechanism for a drill guide. FIG. 30 shows a drill guide 138, a base 140, two keys 142, and two bolts 144. The base 140 has two sidewalls 146. Each of the sidewalls has a keyway or groove 148. The drill guide 138 has an upper surface 150, a lower surface 152, and two sidewalls 154 connecting the upper surface 150 and the lower surface 152. The lower surface 152 has an opening 156. Each of the sidewalls 154 has a keyway or groove 158, and two bores 160. The opening 156, the sidewalls 154, and the upper surface 150 form a channel 162 receiving the base 140. Each of the keys 142 has two threaded holes 164. The keys 142 are inserted between the keyway 148 of the base and the keyway 158 of the drill guide. The bolts 144 pass through the bores 160 of the drill guide and engage with the threaded holes 164 of the keys.

FIG. 31 shows the drill guide 138 is secured in a position to drill pocket holes shown by imaginary lines in a workpiece 166 to assemble the workpiece 166 to an adjacent workpiece 168. As the bolts 144 are tightened the lower surface 152 is pressed against the workpiece 166 thereby providing additional clamping effects.

FIGS. 32–39 show a pocket hole drilling and screw installation jig 170 according to the second embodiment of the present invention. The jig 170 may also be used as a straight edge clamping device for woodworking. The second embodiment is different from the first embodiment in that a drill guide 172 is fixed to the end 36 of the base 12, and a first stop 174 is movably secured to the drill guide 172.

Figure 32:
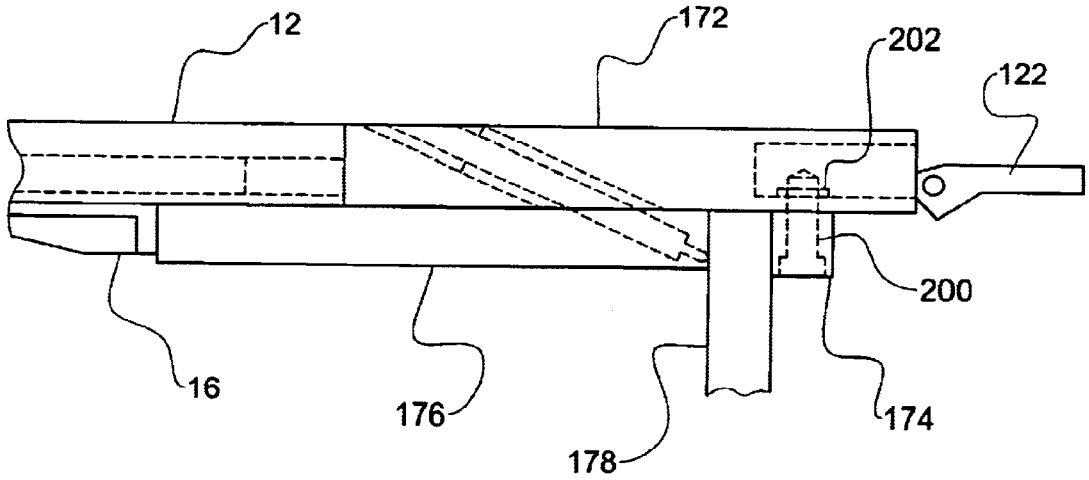
FIG. 32 is a partial front elevational view of a straight edge clamping device according to another embodiment of the present invention.
Figure 33:
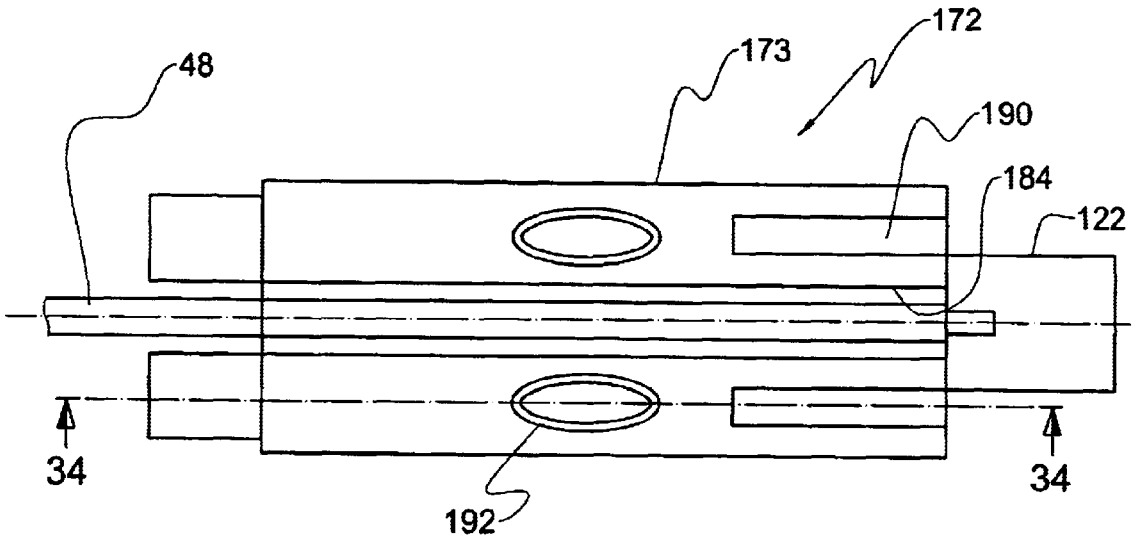
FIG. 33 is a plan view of a drill guide.
Figure 34:
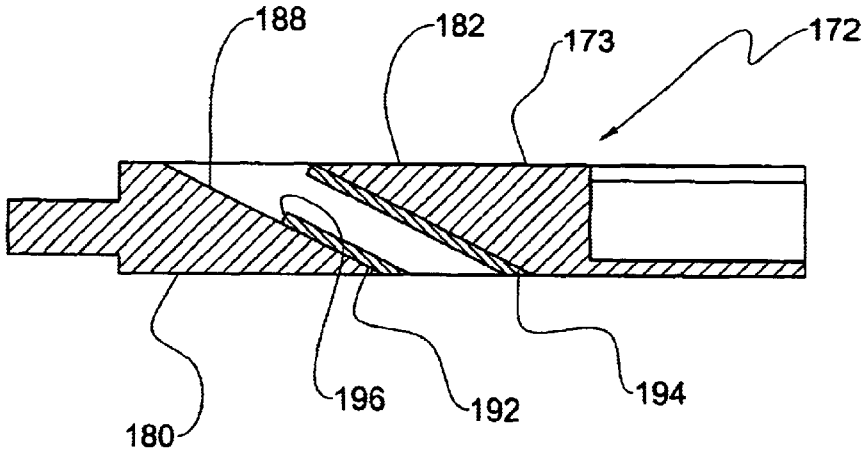
FIG. 34 is a cross-sectional view taken along 34—34 in FIG. 33.
Figure 35:
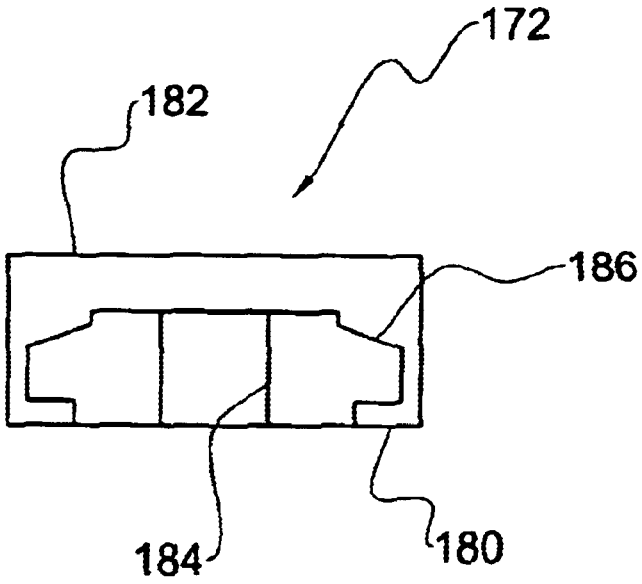
FIG. 35 is a left side elevational view of the drill guide.
Figure 36:
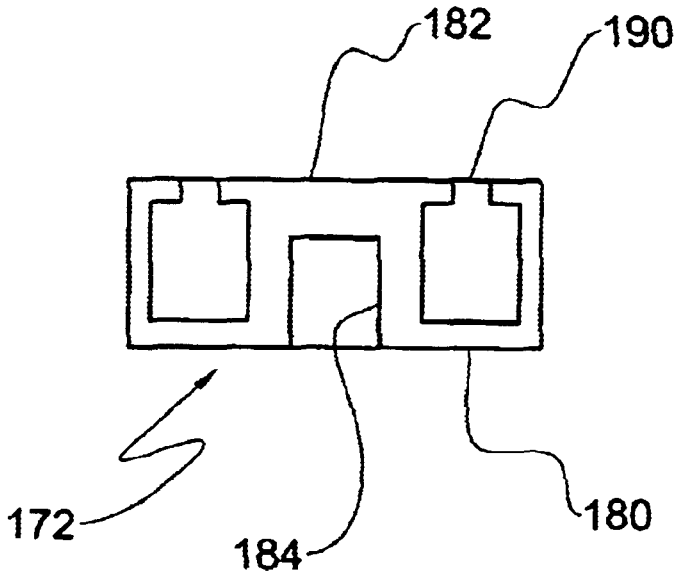
FIG. 36 is a right side elevational view of the drill guide.

FIG. 32 shows two workpieces 176, 178 secured between the first stop 174 and the second stop 16. The movable first stop 174 accommodates varying thickness of the workpiece 178 to properly position the workpieces 176, 178 relative to the drill guide 172.

As shown in FIGS. 32–36, the drill guide 172 has a body 173 and two drill guide portions 192. The body 173 has a lower surface 180 that is flush with the lower wall 24 of the base 12, an upper surface 182 that is opposite with the lower surface 180, a channel 184 to receive the rod 48, two projections 186 inserted into the end 36 of the base 12, two through holes 188 obliquely formed in the body 173, and two channels 190 positioned opposite to the projections 186 are provided in a shape of a bushing to accommodate the first stop 174. Each of the drill guide portions 192 has an end 194 terminating flush with the lower surface 180 and a stop flange 196 at the other end. The drill guide portions 192 are inserted into the holes 188. The drill guide portions 192 may be omitted and the holes 188 may guide the drills. In this case, stop flanges are provided at the holes 188. The holes 188 and thus the drill guide portions 192 may be positioned with the width of the base because the drill 172 is fixed to the end of the base 12.

Figure 37:
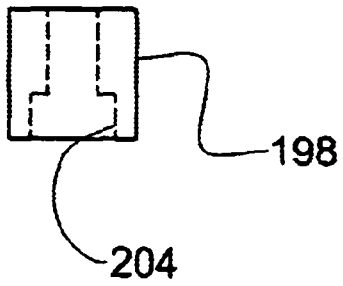
FIG. 37 is an elevational view of a first stop.
Figure 38:
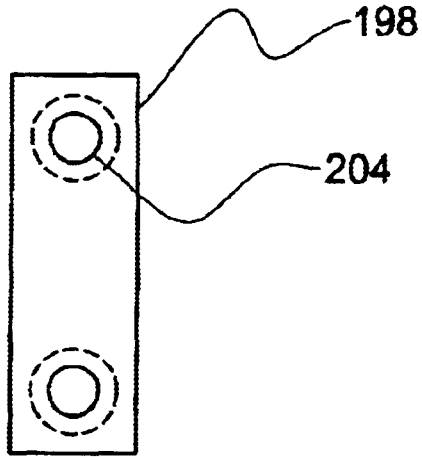
FIG. 38 is a plan view of the first stop.
Figure 39:
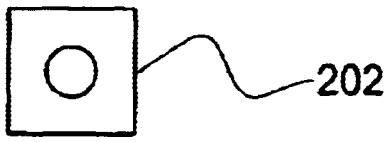
FIG. 39 is a plan view of a nut for the first stop.

As shown in FIGS. 37–39, the first stop 174 includes a rectangular stop block 198, two bolts 200 (refer to FIG. 2), and two square nuts 202. The stop block 198 has two stepped bores 204 to receive the bolts 200. The square nuts 202 are received in the channels 190 of the drill guide 172.

The second stop 16 secures the workpiece 176 and then the cam lever 122 is pivoted to tightly clamp the workpieces 176, 178. After the workpieces 176, 178 are properly positioned relative to the drill guide 172, the stop block 198 is moved to contact the workpiece 178, and the bolts 200 are fastened to the nuts 202 thereby fixing he first stop 174 to the drill guide 172. Drilling pocket holes and depositing screws are performed similarly as explained in the first embodiment.

With the above construction, the straight edge clamp provides stability after the workpieces are clamped and during wood working on the workpieces, for example, forming a cut edge with a circular hand saw, forming a trimmed edge with a hand router, or holding accessory tool against a workpiece, for example, to form pocket holes.

Therefore, the dimensional accuracy of the finished product, for example the positional accuracy of the pocket holes, improves. In addition, the improved straight edge clamp can be manufactured without increasing the manufacturing appreciably since it does not require more material or increased complexity of manufacturing process.

Although the invention has been described in considerable detail, other versions are possible by converting the aforementioned construction. Therefore, the scope of the invention shall not be limited by the specification specified above and the appended claims.

What is claimed is:

1. A straight edge clamping device for clamping workpieces comprising:

a) an elongated hollow base having a constant cross-section, the base having a first end, a second end, a flat lower wall for contacting workpieces, an upper wall, and two sidewalls connecting the lower wall and the upper wall;

b) a first stop fixed at the first end of the base;

c) a second stop movably provided along the base; and d) a clamp for holding the workpieces together;

wherein the lower wall of.the base has an opening, and the opening, the lower wall, the upper wall, and the sidewalls of the base define a channel, wherein the second stop has a body movably received in the channel of the base and a stop for securing the workpieces, wherein the body of the second stop has a shape reverse to the shape of the channel of the base so that the body and the channel interlock, and wherein the upper wall of the base has one or more recesses, wherein the width of each of the recesses is smaller than the distance between the two sidewalls by a predetermined distance, and wherein the body of the second stop has one or more projections having a shape reverse to the shape of the recesses so that the recesses and the projections interlock.

2. A straight edge clamping device of claim 1 wherein the base further comprises two slant walls between the sidewalls and the upper wall.

3. A straight edge clamping device of claim 1 wherein the angle between the slant walls and the sidewalls is approximately 45 degrees.

4. A straight edge clamping device of claim 1 wherein the first stop has a body inserted in the channel of the base and a stop for securing the workpieces, wherein the body of the first stop has a shape reverse to the shape of the channel of the base so that the body and the channel interlock, and wherein the body of the first stop has one or more projections having a shape reverse to the shape of the recesses so that the recesses and the projections interlock.

5. A straight edge clamping device of claim 1 wherein the recess of the base is rectangular and the projection of the second stop is rectangular.

6. A straight edge clamping device of claim 5 wherein the depth of the recess of the base is approximately one sixteenth of an inch, and wherein the height of the projection of the second stop is approximately one sixteenth of an inch.

7. A straight edge clamping device of claim 5 wherein the depth of the recess of the base is approximately one eighth of an inch, and wherein the height of the projection of the second stop is approximately one eighth of an inch.

8. A straight edge clamping device of claim 1 wherein the upper wall of the base further comprises a guide channel, and the clamping device further comprises a drill guide movably provided along the base, and wherein the drill guide has a fastener that is guided in the guide channel of the base.

9. A straight edge clamping device for clamping workpieces comprising:

a) an elongated hollow base having a constant cross-section, the base having a first end, a second end, a flat lower wall for contacting workpieces, an upper wall, and two sidewalls connecting the lower wall and the upper wall;

b) a drill guide attached at the first end of the base;

c) a first stop movably provided along the drill guide;

d) a second stop movably provided along the base; and e) a clamp for holding the workpieces together;

wherein the lower wall of the base has an opening, and the opening, the lower wall, the upper wall, and the sidewalls of the base define a channel, wherein the second stop has a body movably received in the channel of the base and a stop for securing the workpieces, wherein the body of the second stop has a shape reverse to the shape of the channel of the base so that the body and the channel interlock, and wherein the upper wall of the base has one or more recesses, wherein the width of each of the recesses is smaller than the distance between the two sidewalls by a predetermined distance, and wherein the body of the second stop has one or more projections having a shape reverse to the shape of the recesses so that the recesses and the projections interlock.

10. A straight edge clamping device of claim 9 wherein the base further comprises two slant walls between the sidewalls and the upper wall.

11. A straight edge clamping device of claim 9 wherein the angle between the slant walls and the sidewalls is approximately 45 degrees.

12. A straight edge clamping device of claim 9 wherein the recess of the base is rectangular and the projection of the second stop is rectangular.

13. A straight edge clamping device of claim 12 wherein the depth of the recess of the base is approximately one sixteenth of an inch, and wherein the height of the projection of the second stop is approximately one sixteenth of an inch.

14. A straight edge clamping device of claim 12 wherein the depth of the recess of the base is approximately one eighth of an inch, and wherein the height of the projection of the second stop is approximately one eighth of an inch.

15. A straight edge clamping device for clamping workpieces comprising:

a) an elongated hollow base having a constant cross-section, the base having a first end, a second end, two lower walls for contacting workpieces, an upper wall, and two sidewalls connecting the lower walls and the upper wall;

b) a first stop fixed at the first end of the base;

c) a second stop movably provided along the base; and d) a clamp for holding the workpieces together;

wherein each of the lower walls has an outer-lower wall and an inner-lower wall, wherein each of the side wall has an outer-side wall and an inner-side wall, wherein the upper wall has an outer-upper wall and an inner-upper wall, wherein the inner-upper wall has a recess, wherein the recess of the inner-upper wall has two vertical-inner-upper walls and a horizontal-inner-upper wall, wherein the inner-lower walls, inner-side walls, the inner-upper wall, and the recess of the inner-upper wall define a channel, wherein the width of the recess is smaller than the distance between the two inner-side walls by a predetermined distance, wherein the second stop has a body movably received in the channel of the base and a stop for securing the workpieces, wherein the body of the second stop has a shape reverse to the shape of the channel of the base so that the body and the channel interlock, and wherein the body of the second stop has a projection having a shape reverse to the shape of the recess so that the recess and the projection interlock.

16. A straight edge clamping device of claim 15 wherein the base further comprises two slant walls between the sidewalls and the upper wall.

17. A straight edge clamping device of claim 15 wherein the first stop has a body inserted in the channel of the base and a stop for securing the workpieces, wherein the body of the first stop has a shape reverse to the shape of the channel of the base so that the body and the channel interlock, and wherein the body of the first stop has a projection having a shape reverse to the shape of the recess so that the recess and the projection interlock.

18. A straight edge clamping device of claim 15 wherein the recess of the base is rectangular and the projection of the second stop is rectangular.

19. A straight edge clamping device of claim 15 wherein the upper wall of the base further comprises a guide channel, and the clamping device further comprises a drill guide movably provided along the base, and wherein the drill guide has a fastener that is guided in the guide channel of the base.

* * * * *